US006040541A

United States Patent [19]

Li

[11] Patent Number: 6,040,541

[45] Date of Patent: Mar. 21, 2000

[54] KEY SWITCH

[75] Inventor: Yu-Chieh Li, Taipei, Taiwan

[73] Assignee: Hon Hai Precision Ind. Co., Ltd., Taipei Hsien, Taiwan

[21] Appl. No.: 09/305,686

[22] Filed: May 4, 1999

[30] Foreign Application Priority Data

Jun. 25, 1998 [TW] Taiwan ..... 87210199

[51] Int. Cl.[7] ..... H01H 13/70

[52] U.S. Cl. ..... 200/344

[58] Field of Search ..... 200/5 A, 512, 200/517, 341, 344, 345; 400/472, 490, 491.2, 495, 495.1

[56] References Cited

U.S. PATENT DOCUMENTS 5,735,390 4/1998 Takagi et al. ..... 200/344
5,763,842 6/1998 Tsai et al. ..... 200/5 A
5,770,824 6/1998 Tsai et al. ..... 200/5 A
5,779,030 7/1998 Ikegami et al. ..... 200/344
5,850,194 12/1998 Lin ..... 341/22

*Primary Examiner*—Michael Friedhofer
*Attorney, Agent, or Firm*—Wei Te Chung

[57] ABSTRACT

A key switch includes a base, a circuit board, a retaining board, a rubber spring, a support linkage and a key cap. A first engaging mechanism and a second engaging mechanism are formed on the base. The circuit board is positioned above the base and comprises a switch electrode. The rubber spring is positioned on the circuit board. The support linkage is engaged with the base, having a first link and a second link pivotably attached together. A pair of engaging pins of the first link engage with the base, and a pair of arcuate faces is formed on the base proximate the engaging pins. A sliding link is formed on the second link to engage with the second engaging mechanism. The key cap engages with the support linkage.

10 Claims, 5 Drawing Sheets

KEY SWITCH

BACKGROUND OF THE INVENTION

The present invention relates to engaging means for attaching a key switch to a keyboard, and especially to engaging means which facilitates assembly of a key switch to a base of a keyboard.

Most common way of inputting information into a computer is through a keyboard. All keyboards comprise a plurality of key switches assembled to a base of the keyboard such as those disclosed in Taiwan Patent Application Nos. 83204123, 84218262, and 84214256, and U.S. Pat. Nos. 5,462,195 and 5,512,719. Although the structure disclosed in these patents is partly different, they all incorporate a key switch engaging structure similar to the one shown in FIG. 7.

As shown in FIG. 7, a link 91 is pivotably attached to a base 92 of a keyboard by means of a pivot pin 93 of the link 91 with a resilient engaging structure 94 formed on the base 92. The pivot pin 93 is inserted through an opening 95 of the engaging structure 94. The diameter of the opening 95 is less than that of the pivot pin 93, thus the engaging structure 94 are outwardly deformed when the pivot pin 93 is forcibly inserted through the opening 95. A significant force is required to deform the engaging structure 94 during insertion of the pivot pin 93. Such a force makes assembly laborious and may damage the elements. In addition, the deformation of the engaging structure 94 increases the dimension of the opening 95 possibly resulting in detachment of the link 91 from the base 92. Furthermore, the complex shape of the engaging structure 94 not only complicates production, but also increases manufacturing costs. In view of the above problems, it is desirable to provide an improved key switch engaging means.

SUMMARY OF THE INVENTION

A main object of the present invention is to provide a key switch engaging means which is not inclined to detach from a base of a keyboard.

Another object of the present invention is to provide a key switch engaging means which can be easily manufactured and assembled to the base of the keyboard.

The above objects are accomplished by providing a key switch engaging means comprising a base and a support linkage. First engaging means is formed on the base. A protrusion outwardly extends from a top portion of a first side of the first engaging means and a concave edge is formed below the protrusion. An arcuate face is formed on a second side of the first engaging means opposite the protrusion. The support linkage includes at least a link having an engaging pin for engaging with the first engaging means. A pair of arms are formed proximate the first engaging means. An arcuate side is formed on each arm to firmly abut against the second side of the first engaging means.

Other objects, advantages and novel features of the invention will become more apparent from the following detailed description when taken in conjunction with the accompanying drawings.

DETAILED DESCRIPTION OF THE INVENTION

Figure 1:
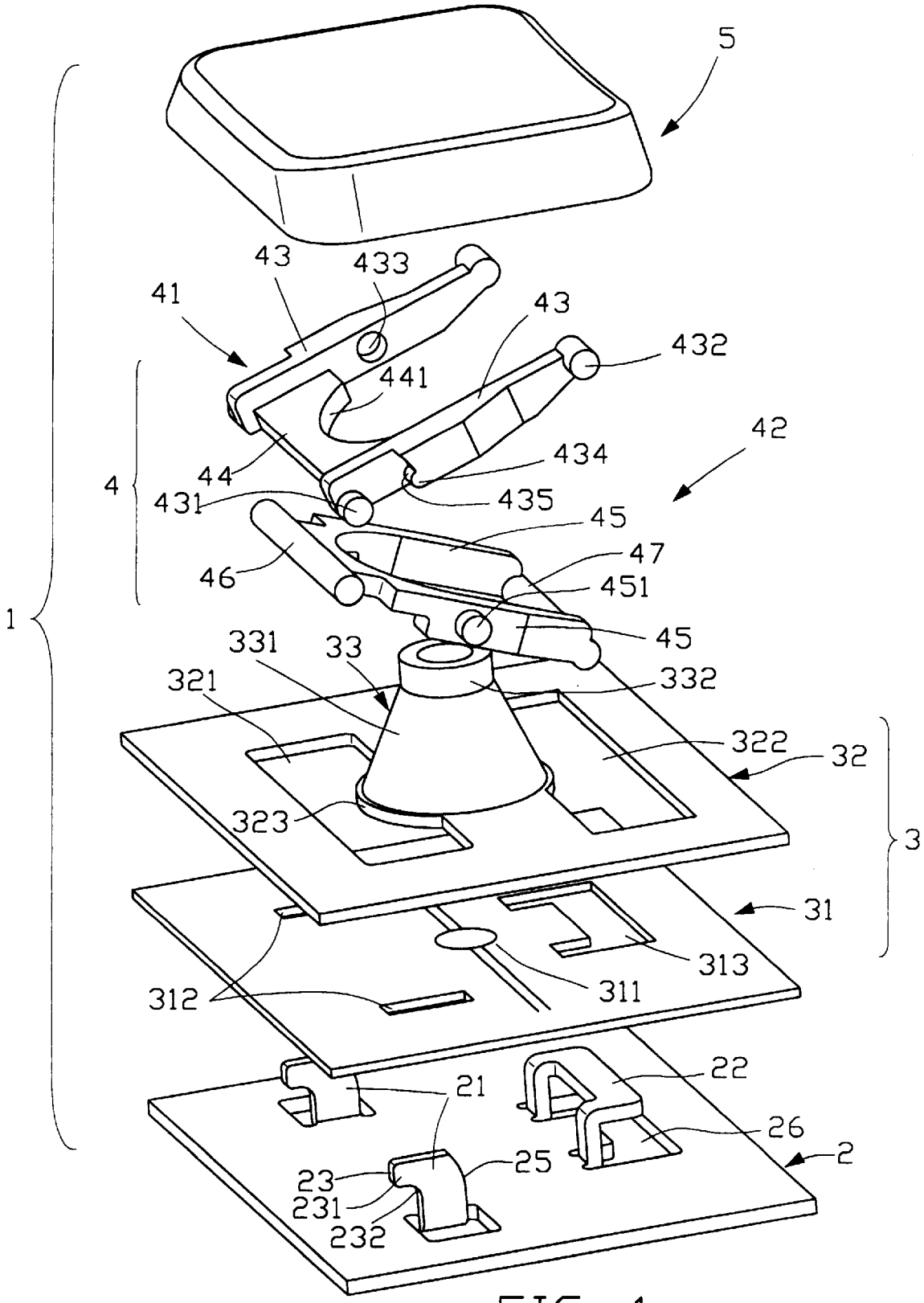
FIG. 1 is an exploded view of the present invention.
Figure 2:
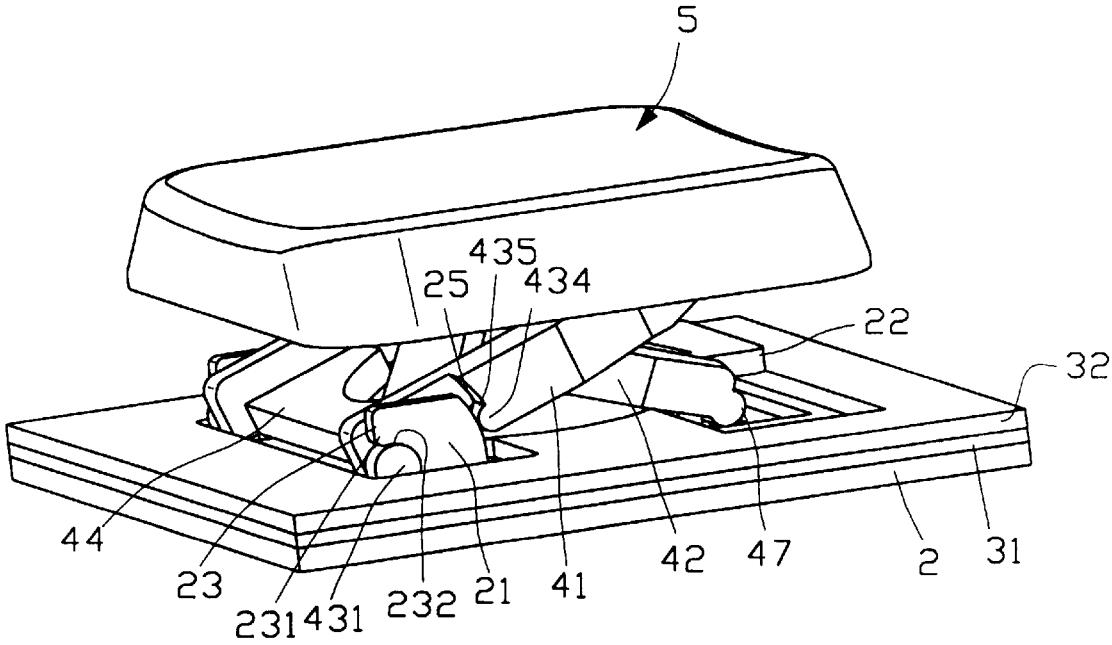
FIG. 2 is an assembled view of FIG. 1.

With reference to FIGS. 1 and 2, a key switch 1 comprises a base 2, a circuit board assembly 3, a support linkage 4, and a key cap 5. The base 2 includes a pair of engaging pieces 21 and an engaging arm 22 upwardly extending therefrom. A first side 23 outwardly extends from a top portion of the engaging piece 21 and the first side 23 has a protrusion 231 and a concave edge 232 defined below the protrusion 231. The engaging piece 21 has a second side forming an arcuate face 25 opposite the first side 23. A groove 26 is defined in the base 2 below the engaging arm 22.

The circuit board assembly 3 comprises a circuit board 31, a retaining board 32, and a rubber spring 33. A pair of openings 321, 322 is defined in the retaining board 32. A support portion 323 is formed in a center of the retaining board 32. The rubber spring 33 is positioned on the support portion 323 and comprises a conical body 331 and a circular flange 332 upwardly extending from the body 331. If a compression force exerted on the rubber spring 33 exceeds a predetermined threshold, the rubber spring 33 will deform and a movable electrode (not shown) formed on the support portion 323 of the retaining board 32 will contact a switch electrode 311 formed on the circuit board 31. Accordingly, the switch electrode 311 is short-circuited and the switching operation is carried out. A plurality of slots 312, 313 are defined in the circuit board to mate with the engaging pieces 21 and the engaging arm 22.

The support linkage 4 is pivotably interconnected between the key cap 5 and the base 2 and comprises a first link 41 and a second link 42. The first link 41 is substantially U-shaped and comprises a pair of first arms 43 and a block 44 formed between ends of the first arms 43. The block 44 forms an inner arcuate side 441. A pair of pivot pins 431 outwardly extends from the end of each first arm 43, and a sliding pivot pin 432 outwardly extends from an opposite end of each first arm 43. The pivot pins and the sliding pivot pins 431, 432 are engaged with the engaging pieces 21 and the key cap 5, respectively. A pair of shaft holes 433 are defined in opposite inner faces of the first arms 43 and a pair of extensions 434 are formed on a central portion of the first arms 43 on opposite outer faces thereof. Each extension 434 has an arcuate edge 435.

The second link 42 includes a pair of second arms 45, a stationary link 46 formed between ends of the second arms 45, and a sliding link 47 formed between opposite ends of the second arms 45. A pair of trunnions 451 for engaging with the shaft holes 433 outwardly extend from opposite central portions of the second arm 45. With this construction, the links 41, 42 are pivotably assembled together, and the stationary link 46 and the sliding link 47 are engaged with the key cap 5 and the engaging arm 22, respectively.

Figure 6:
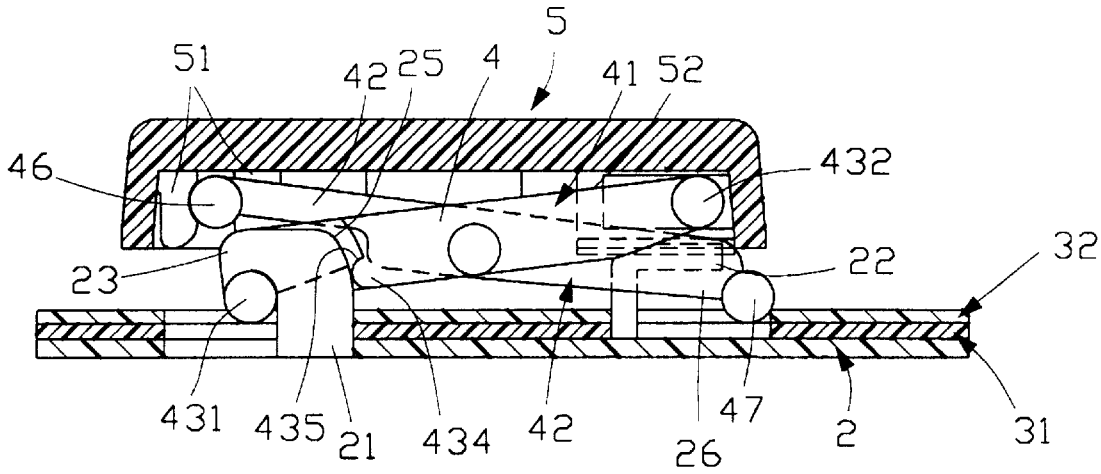
FIG. 6 is a cross sectional view of FIG. 2.
Figure 7:
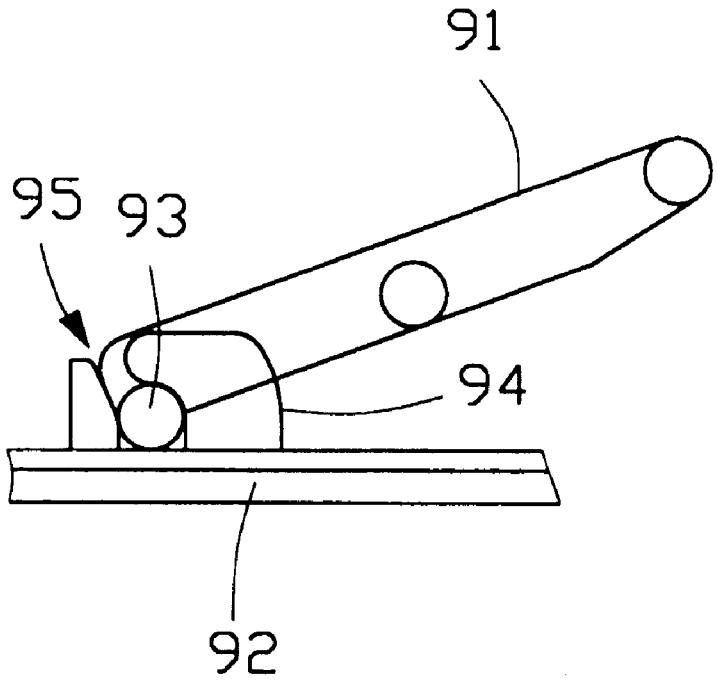
FIG. 7 (PRIOR ART)
FIG. 7 is a schematic diagram of a key switch engaging means in accordance with the prior art.

With reference to FIG. 6, the engaging walls 51, 52 are formed on inner side walls of the key cap 5. The engaging wall 51 engages and pivotably retains the stationary link 46 of the second link 42. The sliding pivot pins 432 slidably engages with the engaging wall 52 in a horizontal direction.

Figure 3:
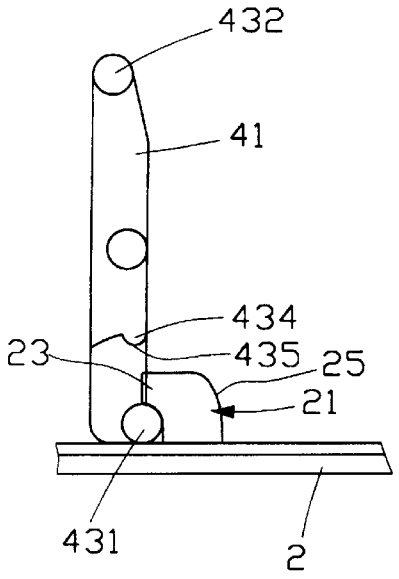
FIG. 3 is a schematic diagram of the key switch engaging means before assembly.
Figure 4:
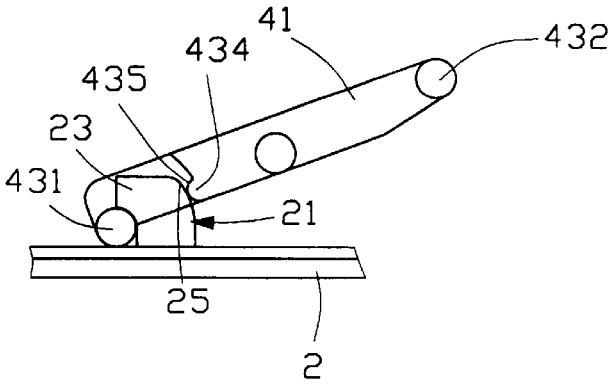
FIG. 4 is a schematic diagram of the key switch engaging means during assembly.
Figure 5:
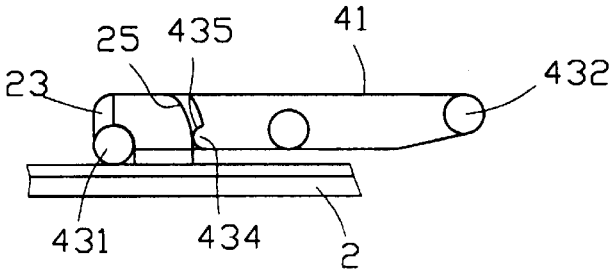
FIG. 5 is a schematic diagram of the key switch engaging means after assembly.

With reference to FIGS. 3, 4, and 5, in assembly, the pivot pin 431 of the first link 41 is received in the first side 23 of the first engaging means 21 and the pivot pin 431 abuts against the first side 23, thus the first link 41 can rotate about the pivot pin 431 toward the base 2. When the extension 434 of the first arm 43 begins to abut against the first engaging means 21 approximately at an angle of 40 degrees between the first link 41 and the base 2, the arcuate edges 435 of the extensions 434 slide along the second side 25 of the engaging piece 21 and the angle between the first link 41 and the base 2 will be less than 40 degrees, at last forming a pivotably engaged relationship between the first link 41 and the base 2. When the support linkage 4 is slightly raised, the sliding link 47 of the second link 42 is horizontally received in the groove 26 and firmly abuts against the engaging arm 22 (as shown in FIG. 6).

When the support linkage 4 is assembled to the base 2, assembly thereof is simplified. Furthermore, since the angle between the base 2 and each link 41, 42 is approximately 20 degrees in the normal, unpressed operating state as shown in FIG. 2, it is insured to prevent the detachment of the support linkage 4 from the base 2.

Alternatively, an engaging rod may be formed between ends of the first arms 43 of the first link 41 thereby replacing the block 44. The engaging pieces 21 may be replaced with an elongate engaging portion having a cross sectional shape similar to the engaging pieces 21 for pivotably engaging with the engaging rod.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A key switch, comprising:

a key cap;

a base having a first engaging means and a second engaging means each upwardly extending therefrom, the first engaging means comprising a first side distal from the second engaging means and a second side proximate the second engaging means;

a support linkage pivotably interconnected between the key cap and the base, consisting of a first link and a second link, the first link comprising a pair of arms, each of the arms having an engaging pin abutting against the first side of the first engaging means and an extension abutting against the second side of the first engaging means for pivotably engaging the first link to the base; and a circuit board assembly disposed above the base and responsive to a downward movement of the key cap to indicate a depression of the key cap.

2. The key switch as claimed in claim 1, wherein the first engaging means comprises two engaging pieces.

3. The key switch as claimed in claim 1, wherein the second engaging means comprises an engaging arm.

4. The key switch as claimed in claim 1, wherein a protrusion is formed on the first side and the protrusion has a concave edge for preventing detachment of the engaging pin of the first link from the first engaging means.

5. The key switch as claimed in claim 1, wherein the second side comprises an arcuate face, and the extension has an arcuate edge for mating with the arcuate face.

6. The key switch as claimed in claim 1, wherein the angle between the first link and the base is approximately 40 degrees when the extension of each of the arms of the first link begins to abut against the second side of the first engaging means.

7. The key switch as claimed in claim 6, wherein the angle of the first link and the base is less than 40 degrees in a normal, unpressed operating state.

8. The key switch as claimed in claim 7, wherein the angle of the first link and the base is 20 degrees in the normal, unpressed operating state.

9. The key switch as claimed in claim 1, wherein the engaging pin comprises a pair of pivot pins.

10. A key switch comprising:

a key cap;

a base having a first engaging means and a second engaging means opposite with each other;

a support linkage including a first link and a second link pivotally connected to each other;

the first link including a pivot pin rotatably engaged with the first engaging means, and the second link including a sliding pivot pin slidably and rotatably engaged within the second engaging means; wherein the first engaging means defines a first side for rotatable engagement with the pivot pin, and when the first link is rotated to 40 degrees with regard to the base, the first engaging means is provided with a second side to engage with an extension of the first link so that the first link can be installed to the first engaging means in a free-force manner while keeping required rotatable engagement therewith when the first link is in an operation manner, thereby preventing harmful deformation of the first engaging means during installation of the first link with regard to the first engaging means.

* * * * *